US006679139B2

(12) United States Patent
Brenizer

(10) Patent No.: US 6,679,139 B2
(45) Date of Patent: Jan. 20, 2004

(54) RATCHETING ADJUSTABLE WRENCH

(75) Inventor: John G. Brenizer, Pueblo, CO (US)

(73) Assignee: Emerson Electric Co., St. Louis, MO (US)

( * ) Notice: Subject to any disclaimer, the term of this patent is extended or adjusted under 35 U.S.C. 154(b) by 144 days.

(21) Appl. No.: 09/817,601

(22) Filed: Mar. 26, 2001

(65) Prior Publication Data

US 2002/0134204 A1 Sep. 26, 2002

(51) Int. Cl.[7] ..... B25B 13/16

(52) U.S. Cl. ..... 81/165; 81/133; 81/157; 81/173

(58) Field of Search ..... 81/133–140, 142–145, 81/157–158, 165–167, 173, 175–176

(56) References Cited

U.S. PATENT DOCUMENTS

| | | | | | |
|---|---|---|---|---|---|
| 1,391,251 | A | | 9/1921 | Ginsberg | 81/165 |
| 1,599,162 | A | | 9/1926 | Brown | 81/165 |
| 3,022,689 | A | | 2/1962 | McComb | 81/165 |
| 3,190,154 | A | * | 6/1965 | Chapman | 81/165 |
| 5,644,957 | A | | 7/1997 | Gustafson et al. | 81/165 |
| 5,746,099 | A | | 5/1998 | Janson | 81/165 |
| 5,771,761 | A | | 6/1998 | Binkowski | 81/99 |
| 5,870,932 | A | | 2/1999 | Brooke | 81/177.8 |
| 5,890,404 | A | | 4/1999 | Stojanowski | 81/165 |
| 5,941,142 | A | | 8/1999 | Janson | 81/165 |
| 6,089,129 | A | * | 7/2000 | Huang | 81/135 X |
| 6,116,121 | A | | 9/2000 | Kitt, Jr. | 81/170 |
| 6,276,241 | B1 | * | 8/2001 | Cornog et al. | 81/170 |

* cited by examiner

*Primary Examiner*—D. S. Meislin
(74) *Attorney, Agent, or Firm*—Howrey Simon Arnold & White LLP

(57) ABSTRACT

A ratcheting adjustable wrench is disclosed. The wrench has a main body defining a wrench head, handle and fixed jaw. The main body is fabricated of hardened sheet metal formed from laminations. The adjustable wrench has a pin/slot guide mechanism to retain and provide position adjustment for an adjustable jaw. A locking mechanism allows the adjustable jaw to ratchet over the corners of a fastener being tightened. In a locked position, the wrench operates like a standard adjustable wrench. Moving a trigger to an unlocked position allows the worm gear mechanism to shift axially for additional travel. The movable jaw engaged to the worm gear is thereby also allowed to shift position so that the adjustable jaw wrench can rotate over the points of the fastener being torqued.

26 Claims, 10 Drawing Sheets

RATCHETING ADJUSTABLE WRENCH

FIELD OF THE INVENTION

The present invention relates generally to an adjustable sliding-jaw wrench and, more particularly to an adjustable sliding-jaw wrench providing a ratcheting mode of operation.

BACKGROUND OF THE INVENTION

An open-end wrench is a type of hand tool used to tighten or loosen a fastener, such as a nut or bolt. One type of open-end wrench is an adjustable sliding-jaw wrench, which uses a worm gear to drive a mating rack formed integrally with an adjustable sliding jaw. Rotating the worm gear adjusts the separation between the sliding jaw and a fixed jaw integrally formed with the handle of the wrench.

Adjustable sliding-jaw wrenches offer the particular advantage that the open-ended jaws can easily slip onto or off a fastener from the side. On the other hand, adjustable sliding-jaw wrenches cannot be used to rotate the fastener more than part of a single revolution unless the fastener is freely accessible. When rotation of the adjustable sliding-jaw wrench is hindered, the wrench must be removed and repositioned to further rotate the fastener.

Socket wrenches allow for a ratcheting mode of operation to torque a fastener without the need to remove and reposition the tool. Unfortunately, socket wrenches cannot slip onto or off of the fastener from the side and cannot be used when access to the top of the fastener is limited. Therefore, it is desirable to combine the features of an adjustable sliding-jaw wrench with a ratcheting mode of operation.

A number of solutions exist in the prior art for combining a ratcheting mode of operation with an adjustable sliding-jaw wrench. Many of the solutions require an extensive amount of manufacturing to accomplish. For example, some solutions use a camming operation or a pivoting handle to achieve the ratcheting effect. Although some of these wrenches may be effective, the difficulty and attendant cost of manufacturing makes them undesirable.

FIGS. 1A–C illustrate an example of a ratcheting adjustable wrench 10 in the prior art as disclosed in U.S. Pat. No. 5,746,099 to Janson. Referring to FIG. 1A, ratcheting adjustable wrench 10 is cast or stamped out of steel and then machined. Wrench 10 includes a wrench head 12 having a handle 14 extending therefrom. A fixed jaw 16 also extends from wrench head 12 opposite handle 14. A receiver 30 defines a longitudinal bore that extends through wrench head 12 and receives a movable member 40 therein. Movable member 40 includes a jaw 42 that opposes fixed jaw 16 and allows wrench 10 to clench a fastener F.

Movable member 40 also includes a toothed rack 44 that communicates with a large opening 50. Large opening 50 extends through wrench head 12 and accommodates a worm gear 70, a spindle 60 and a compression spring 62 therein. Spindle 60 is inserted into large opening 50 through a threaded aperture 64. Worm gear 70 and spring 62 are positioned in large opening 50. Worm gear 70 contains an axial bore (not shown), a widened portion of which receives one end of spring 62. Spindle 60 passes through spring 62 and worm gear 70 until the end of spindle 60 lands in an aperture 66 opposite threaded aperture 64. Spindle 60 then threads into threaded aperture 64 to support worm gear 70 and spring 62 within large opening 50. In this way, worm gear 70 rides on spindle 60, and spring 62 biases worm gear 70 to the top of large opening 50.

Large opening 50 extends slightly into receiver 30 so that worm gear 70 engages with rack 44 on movable member 40. A smaller opening 52 extends from large opening 50 on the side opposite from receiver 30. Smaller opening 52 accepts a locking member 80 that is slideably mounted within smaller opening 52. Locking member 80, shown partially cut-away in FIG. 1A, slides within smaller opening 52 and covers a compression spring 88 in smaller opening 52. Ideally, locking member 80 is assembled before the assembly of worm gear 70, spindle 60 and spring 62 as described above. Those skilled in the art will appreciate that wrench 10 offers a number of challenges to manufacture and assemble.

In FIG. 1A, locking member 80 engages worm gear 70 in a locked position. The biasing of spring 88 urges locking member 80 towards spindle 60 in order to support worm gear 70. In particular, a side protrusion 82 on locking member 80 is interposed between worm gear 70 and a sidewall 54 of large opening 50. With locking member 80 in this locked position, worm gear 70 cannot slide along spindle 60. Furthermore, movable member 40, which is engaged with worm gear 70, cannot move within receiver 30 unless worm gear 70 is rotated. With the support of locking member 80, movable jaw 42 remains stationary relative to fixed jaw 16 so that wrench 10 may tighten or loosen the fastener F.

In FIG. 1B, locking member 80 is retracted from worm gear 70 to an unlocked position within small opening 52. The retraction of locking member 80 overcomes the biasing of spring 88. With locking member 80 in the unlocked position, worm gear 70 is no longer blocked by protrusion 82 and may slide along spindle 60. Consequently, movable member 40, engaged with worm gear 70, may also slide within receiver 60. With this freedom of movement, movable jaw 42 may slide away from fixed jaw 16 and accommodate the wider corner-to-corner dimension of the fastener F.

Although the design allows adjustable jaw 42 to move in relation to fixed jaw 12 when in the unlocked position, some problems exist in the operation of the tool. One particular disadvantage in the tool lies in the engagement of locking member 80 with worm gear 70. As described in FIG. 1A, locking member 80 engages worm gear 70 when in the locked position. FIG. 1C illustrates a top view of the engagement of locking member 80 and worm gear 70.

With reference to FIG. 1A and more particularly to FIG. 1C, spindle 60 passes through a bore 72 of worm gear 70. Spring 62 surrounds spindle 60 and lies partially within bore 72 of worm gear 70. Locking member 80 is H-shaped with first and second protrusions 82*a*, 82*b*, a cross connector 84, and a slideway 86. Protrusions 82*a*, 82*b* interpose between worm gear 70 and sidewall 54 of large opening 50 to prevent worm gear 70 from sliding along spindle 60. Cross connector 84 may also interpose between worm gear 70 and sidewall 54. A portion of wrench head 12 is located within slideway 86, and spring 88 biases locking member 80 towards spindle 60 and worm gear 70.

Because worm gear 70 rides on spindle 60, the protrusions 82*a*, 82*b* and cross connector 84 cannot support worm gear 70 on its axial center 72. Protrusions 82*a*, 82*b* and cross connector 84 must fit around spindle 60 and spring 64 to accommodate them. Furthermore, the extension of the protrusions 82*a*, 82*b* under worm gear 70 is limited so that the protrusions 82*a*, 82*b* do not contact rack 44 of movable member 40. Therefore, locking member 80 only partially supports worm gear 70. The engagement of locking member 80 with worm gear 70 represents an inherently weak structure of the wrench 10.

When the locked wrench 10 in FIG. 1A is used to tighten or loosen the fastener F, the corners of the fastener F bear on movable jaw 42. Worm gear 70 is forced against locking member 80. Because the engagement between locking member 80 with worm gear 70 is not axially aligned with the force applied, moment forces may be created on the structure of worm gear 70, spindle 60 and locking member 80. With the forces not axially aligned, wrench 10 may fail when torquing the fastener F.

Furthermore, the structure of wrench 10 requires careful machining of each component of the worm gear 70, spindle 60 and locking member 80 to create the engagement of the locking mechanism. To avoid excessive "play" between the components, stringent tolerances and tight interconnections are required. Tolerances that do not meet these requirements may also cause wrench 10 to wear or fail.

Besides posing inherent structural problems, the movement of locking member 80 poses additional operational difficulties. Although locking member 80 is supported on one side by sidewall 54 of large opening 50, locking member 80 lacks additional reinforcement when moving from the locked position in FIG. 1A to the unlocked position in FIG. 1B. Locking member 80 can thus dislodge when moving between the locked and unlocked positions.

When returning to a locked position from the unlocked position in FIG. 1B, locking member 80 must properly insert between the bottom of worm gear 70 and sidewall 54. Because locking member 80 includes the protrusions 82*a*, 82*b*, locking member 80 may catch the winding tooth or the side of worm gear 70 before spring 62 moves worm gear 70. Locking member 80 may also dislodge from smaller opening 52 if it catches on worm gear 70. Locking member 80, therefore, has a potential of jamming on the side of worm gear 70. This would particularly be the case when the user of wrench 10 in FIG. 1B releases locking member 80 before the jaws 16, 42 are fully ratcheted past the corners of the fastener F.

The present invention is directed to overcoming, or at least reducing the effects of, one or more of the problems set forth above.

SUMMARY OF THE INVENTION

In view of the foregoing and other considerations, the present invention relates to an adjustable sliding-jaw wrench providing a ratcheting mode of operation.

In accordance with one aspect of the present invention, a wrench includes a wrench head having a fixed jaw thereon. A movable unit is disposed in the wrench head. The movable unit includes a rack partially extending into a first aperture in the wrench head and includes a jaw opposing the fixed jaw. The wrench also includes a worm gear positioned within the first aperture. The worm gear includes a rotatable portion and a spindle. The rotatable portion is engaged with the rack that is axially moveable within the first aperture between a first and a second position. The spindle extends axially from the rotatable portion and is axially moveable therewith. The spindle has a distal end and is slideably situated within a spindleway communicating with the first aperture. The wrench includes a locking mechanism positioned in a second aperture communicating with the spindleway. The locking mechanism is movable between a locked and an unlocked position. In the locked position, the locking mechanism is interposed between the distal end of the spindle and a side of the second aperture to maintain the worm gear in the first position.

In accordance with another aspect of the present invention, a wrench includes a wrench head having a fixed jaw. A first lamination defines one side of the wrench head. A second lamination defines another side of the wrench head. An intermediate lamination defines at least a portion of the wrench head and is situated between the first and second laminations. Each of the first, second and intermediate laminations defines a first aperture therein. A movable jaw unit, disposed in the wrench head, includes a jaw opposing the fixed jaw and a rack gear partially extending into the first aperture. A worm gear engages the rack gear and is movable within the first aperture between a first and a second position. The worm gear has a rotatable portion and a spindle extending axially from the rotatable portion. The spindle has a distal end that is slideably situated within a first cutaway communicating with the first aperture in the intermediate lamination. A locking mechanism is disposed in a second cutaway communicating with the first cutaway in the intermediate lamination. The locking mechanism is movable between a locked and an unlocked position. In the locked position, the locking mechanism is interposed between the distal end of the second spindle and a side of the second cutaway to hold the worm gear in the first position.

In accordance with still another aspect of the present invention, an adjustable jaw wrench includes a wrench head having a fixed jaw thereon. A movable unit disposed in the wrench head has a jaw opposing the fixed jaw. A worm gear is positioned in the wrench head and is engaged with the movable unit. The wrench includes means for moving the worm gear along an axial line of movement between a first and a second position. The wrench includes means for supporting the worm gear to retain the worm gear in the first position. The supporting means is aligned along the axial line of movement. The wrench also includes means for freeing the worm gear to move towards the second position.

In accordance with another aspect of the present invention, an apparatus for gripping a workpiece includes a first element having a fixed jaw thereon and a second element disposed in the first element. The second element has a rack thereon and a jaw opposing the fixed jaw. A rotatable portion is positioned in the first element to engage the rack, is movable along an axial line between a first and a second position and has an axial element extending therefrom. A blocking element positioned in the first element is movable between engaged and disengaged positions with respect to a distal end of the axial element. In the engaged position, the blocking element substantially aligns with the distal end of the axial element and maintains the rotatable portion in the first position. Moving the blocking element to the disengaged position frees the distal end of the axial element and allows the rotatable portion to move to the second position.

In yet another aspect, the present invention includes a method for selectively rotating a fastener with an adjustable jaw wrench or ratcheting a movable jaw and a fixed jaw of the wrench about the fastener. The method includes the following steps: interconnecting a worm gear with the movable jaw; providing the worm gear with a path of axial movement in the wrench head; allowing the wrench to rotate the fastener; and allowing the wrench to ratchet about the fastener. Allowing the wrench to rotate the fastener includes hindering the axial movement of the worm gear by selectively interposing a blocking element in the path of the axial movement of the worm gear. Allowing the wrench to ratchet about the fastener includes freeing the axial movement of the worm gear by selectively displacing the blocking element from the path of the axial movement of the worm gear.

BRIEF DESCRIPTION OF THE DRAWINGS

The foregoing summary, a preferred embodiment and other aspects of the present invention will be best understood with reference to the following detailed description of specific embodiments of the invention and the accompanying drawings, in which.

Figure 1A:
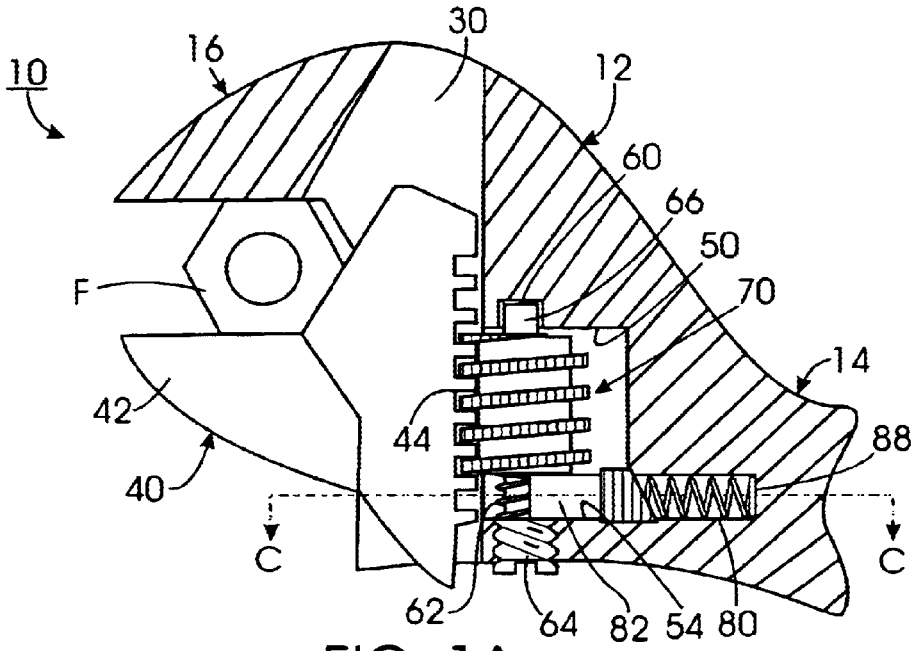
FIG. 1A (Prior Art)
FIGS. 1A–C illustrate a ratcheting adjustable wrench according to the prior art.
Figure 1B:
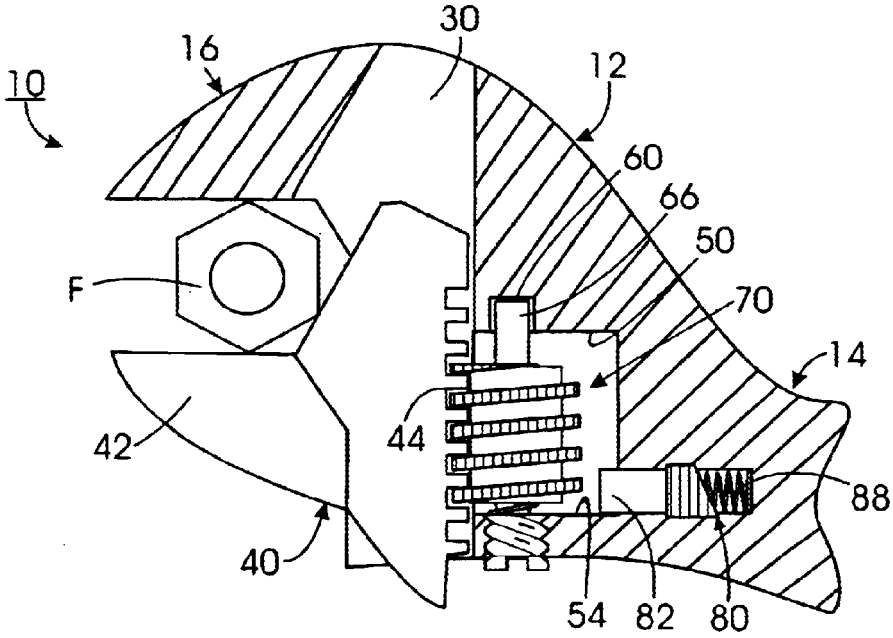
FIG. 1B (Prior Art)
Figure 1C:
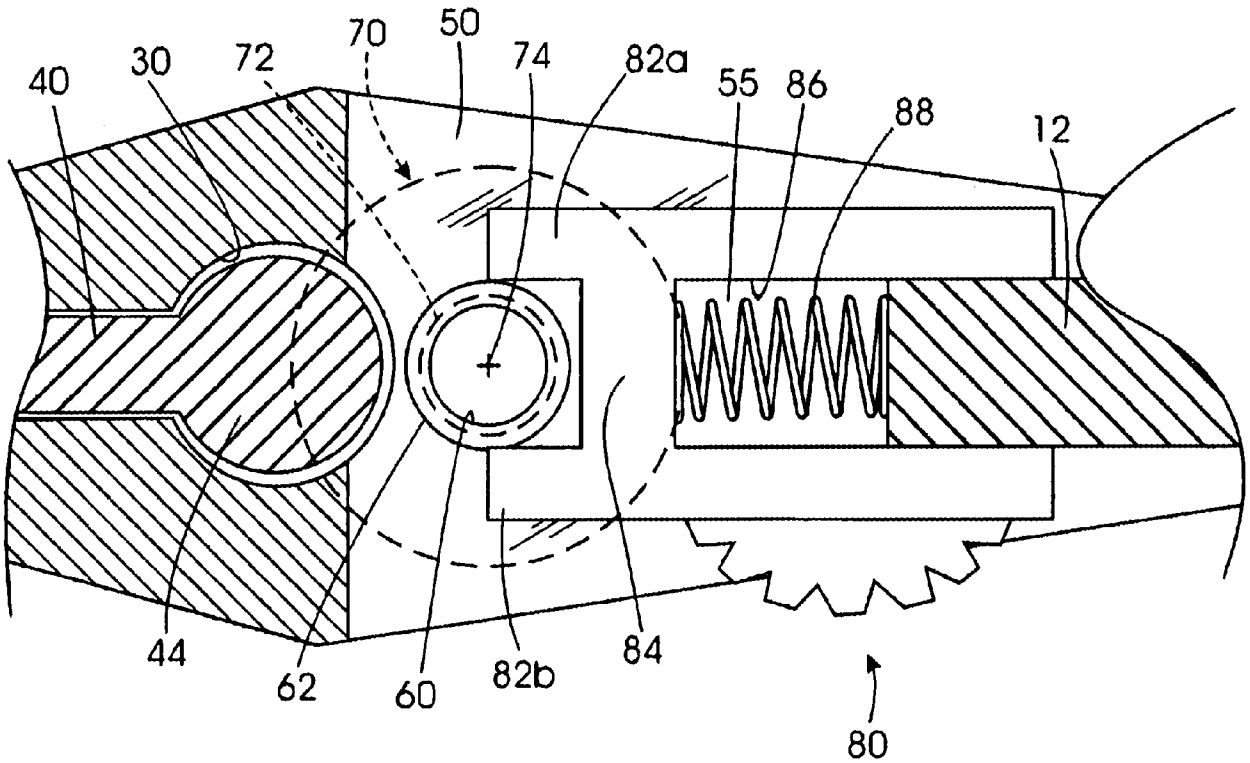
FIG. 1C (Prior Art)

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is intended to cover all modifications, equivalents and alternatives falling within the scope of the invention as defined by the appended claims.

DETAILED DESCRIPTION OF THE INVENTION

Figure 2:
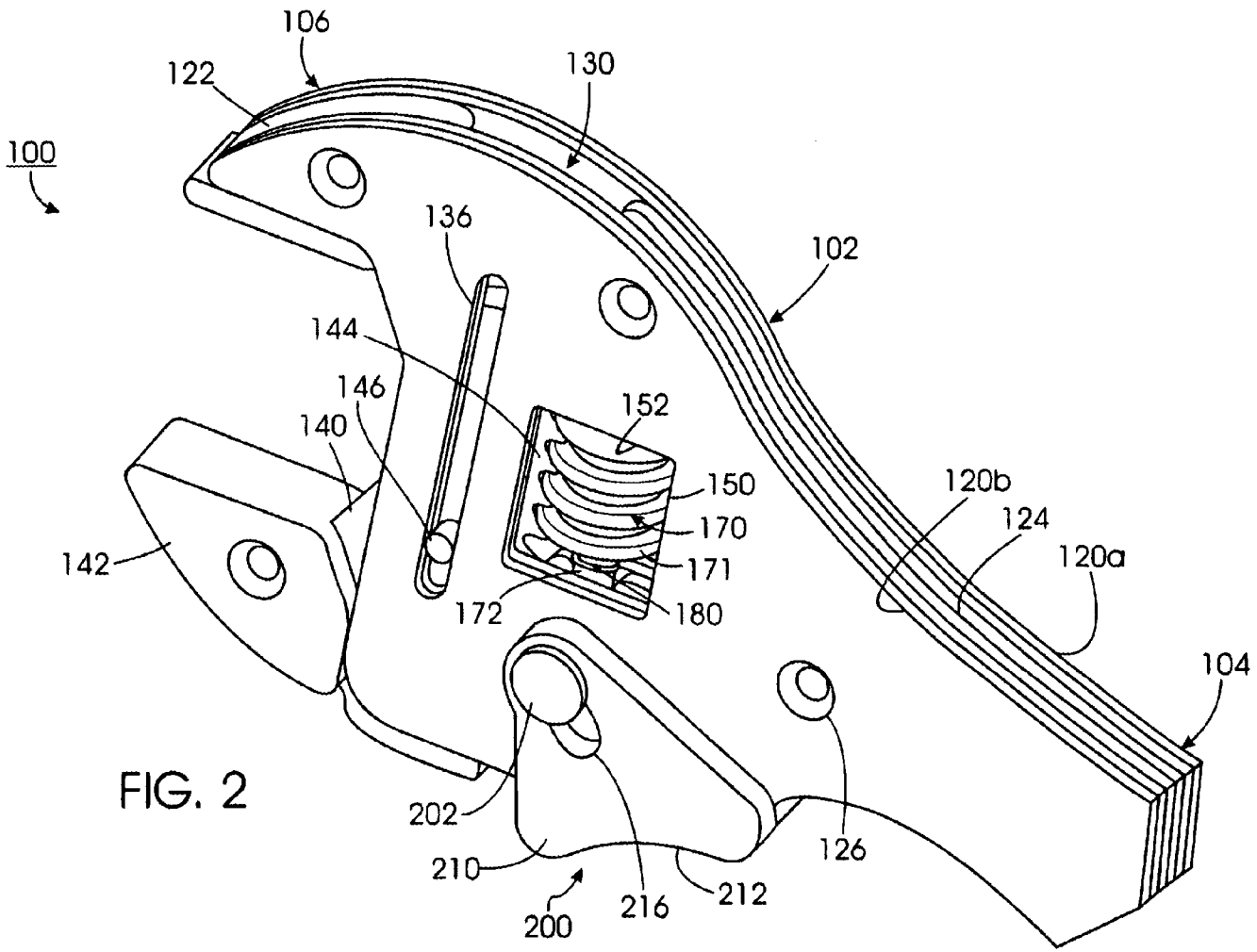
FIG. 2 illustrates an isometric view of a ratcheting adjustable wrench according to the present invention.

Illustrative embodiments will now be described with reference to the accompanying Figures. Turning to FIG. 2, a ratcheting adjustable wrench 100 includes a wrench head 102, which has a handle 104 extending therefrom and a fixed jaw 106 mounted thereon opposite handle 104. In a preferred embodiment, wrench head 102, handle 104, fixed jaw 106 and other portions of ratcheting adjustable wrench 100 are formed from a plurality of laminations of sheet metal. The laminations may be composed of 1075 cold-rolled steel that is hardened and drawn by conventional heat treatment methods to a Rockwell hardness of 40 to 60.

As an example construction for ratcheting adjustable wrench 100, the plurality of laminations include side laminations 120*a* and 120*b*. The side laminations 120*a*, 120*b* sandwich one or more intermediate laminations 124 within wrench head 102. The plurality of laminations 120*a*, 120*b*, and 124 for constructing wrench 100 may have a thickness of, for example, approximately 0.06" to 0.08". Wrench 100 may have as many as six or more laminations and an overall thickness of approximately 0.4" to 0.5". Fixed jaw 106 may also include an intermediate lamination 122. A plurality of steel rivets 126 holds together all of the laminations 120*a*, 120*b*, 122, 124 and any other laminations not shown.

Wrench 100 includes an adjustable jaw unit 140, a worm gear 170 and a locking mechanism 200. Adjustable jaw unit 140 is disposed in a guideway 130 in wrench head 102. Adjustable jaw unit 140 includes a jaw 142 opposing fixed jaw 106 and a rack 144 partially extending in to an oversized aperture 150 defined in wrench head 102. Worm gear 170 is positioned in aperture 150 and is engaged with rack 144 of adjustable jaw unit 140. Locking mechanism 200 is mounted on wrench head 102 and engages worm gear 170 as described in detail below.

Wrench head 102 contains a guideway 130 formed between the side laminations 120*a*, 120*b* that accommodates adjustable jaw unit 140 therein. Guideway 130 extends through wrench head 102 such that adjustable jaw unit 140 may slide therein. A slot/pin arrangement is provided to guide adjustable jaw unit 140 within guideway 130. The slot/pin arrangement includes a slot 136 in side lamination 120*b*. Slot 136 receives a pin 146 attached to adjustable jaw unit 140. Pin 146 extends through jaw 140 into a parallel slot (not shown) provided in the side laminations 120*a* on the reverse of wrench head 102. This slot/pin arrangement guides movable jaw 142 and rack 144 during movement or adjustment of adjustable jaw unit 140.

Aperture 150 extends through the laminations 120*a*, 124, and 120*b* from one side of wrench head 102 to the other. Aperture 150 accommodates worm gear 170 therein. Worm gear 170 includes a rotatable portion 171 and an axial member 172. Rotatable portion 171 has a winding tooth, which engages with rack 144 on adjustable jaw unit 140. Aperture 150 is wider than the axial dimension of worm gear 170, allowing worm gear 170 to move axially within aperture 150. Axial member 172 is mutually movable with rotatable portion 171 and defines a spindle that extends axially from rotatable portion 171. A biasing member or spring 180 on axial member 172 urges worm gear 170 towards a sidewall 152 of aperture 150.

Adjustable jaw unit 140 may slide within guideway 130 in two ways. First, rotation of worm gear 170 moves adjustable jaw unit 140 within guideway 130 and adjusts the separation between fixed jaw 106 and movable jaw 142. Second, axial movement of worm gear 170 within aperture 150 also moves adjustable jaw unit 140 within guideway 130 and alters the distance between fixed jaw 106 and movable jaw 142.

Locking mechanism 200 is mounted on wrench head 102. Movement of locking mechanism 200 between a locked and an unlocked position allows wrench 100 to operate in two modes, a standard mode and a ratcheting mode. More specifically, engaging or disengaging locking mechanism 200 with axial member 172 permits or restricts the axial movement of worm gear 170 within aperture 150 and thereby controls the movement of adjustable jaw unit 140.

In the locked position as shown in FIG. 2, locking mechanism 200 hinders the movement of worm gear 170 within aperture 150 and allows wrench 100 to operate as a standard adjustable jaw wrench. Specifically, locking mechanism 200 engages a distal end (not shown) of axial member 172 and blocks the axial movement of worm gear 170. Consequently, adjustable jaw unit 140 with movable jaw 142 remains locked in position to tighten or loosen a fastener either clockwise or counterclockwise. In contrast, moving the locking mechanism 200 to an unlocked position (not shown) converts the operation of the wrench 100 to the ratcheting mode. When locking mechanism 200 is disengaged from axial member 172, worm gear 170 may shift axially in aperture 150, which permits adjustable jaw unit 140 to also move within guideway 130. Movable jaw 142 may then shift positions so that wrench 100 can rotate over the points of a fastener being torqued.

In a preferred embodiment, locking mechanism 200 includes a cross member 202 and a trigger 210. Trigger 210 includes a trigger surface 212 and two bifurcations 214 (only one of which is visible in FIG. 2) which extend therefrom. The bifurcations 214 define elongated apertures 216 therein. Cross member 202 extends through the elongated apertures 216 and the laminations 120*a*, 120*b*, and 124. A user of wrench 100 uses a thumb or finger to press trigger surface 121 against wrench head 102. The bifurcations 214 leverage cross member 202, which then moves laterally within wrench head 102. Lateral movement of cross member 202 disengages cross member 202 from the distal end of axial member 172 and permits axial movement of worm gear 170 within aperture 150.

Figure 3A:
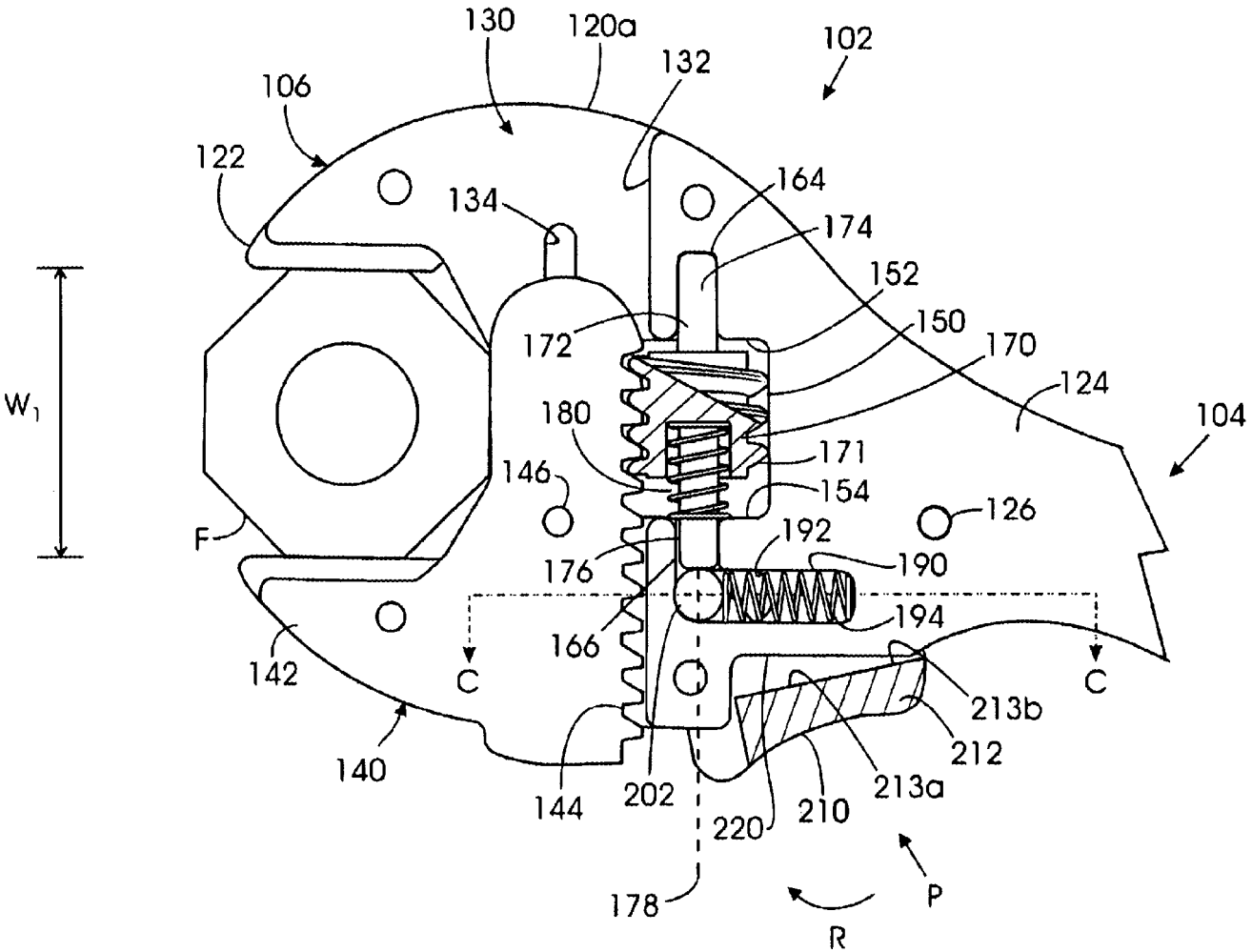
FIG. 3A illustrates a cross-sectional side view of a ratcheting adjustable wrench in a locked position according to the present invention.
Figure 3B:
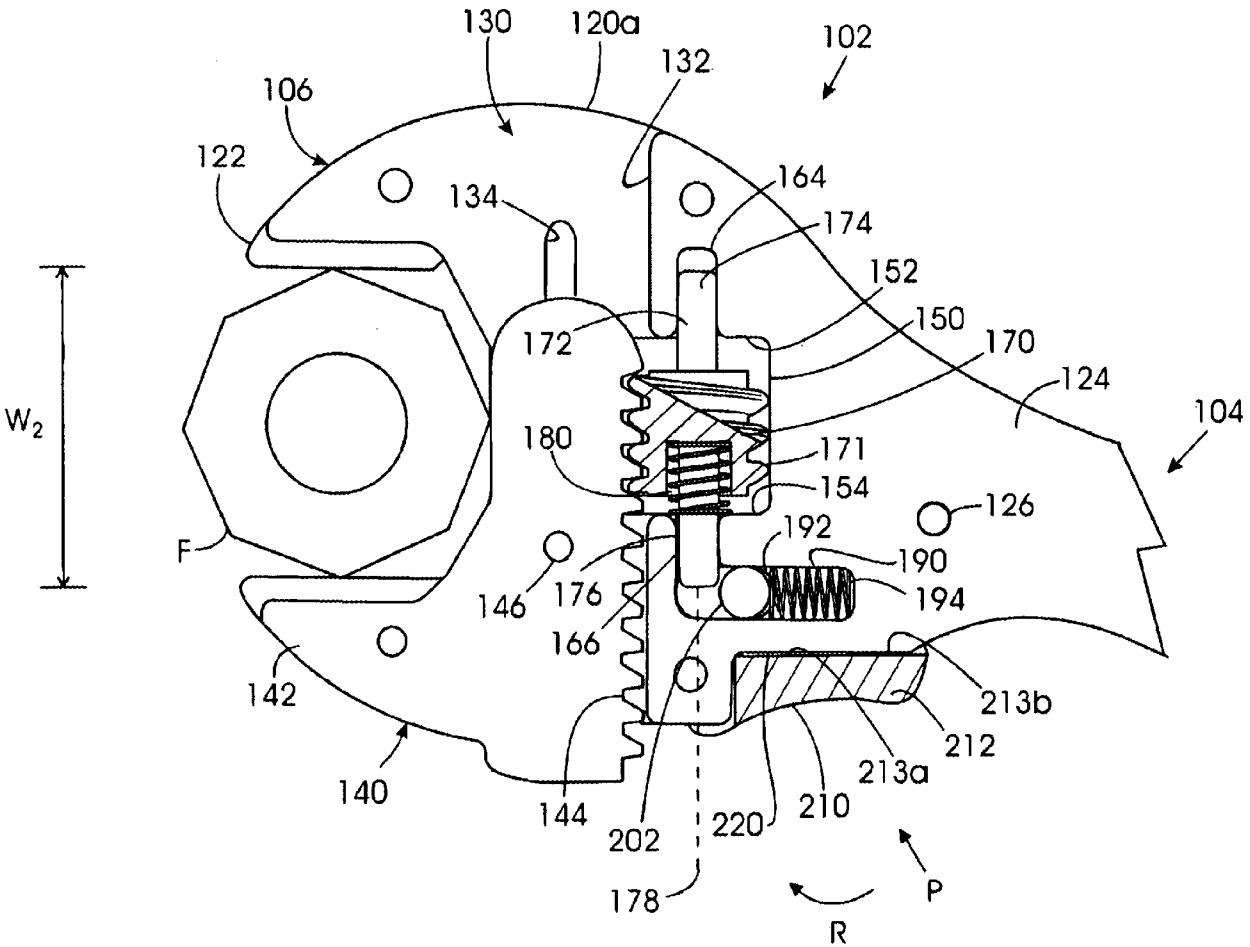
FIG. 3B illustrates another cross-sectional side view of the ratcheting adjustable wrench in an unlocked position according to the present invention.
Figure 4:
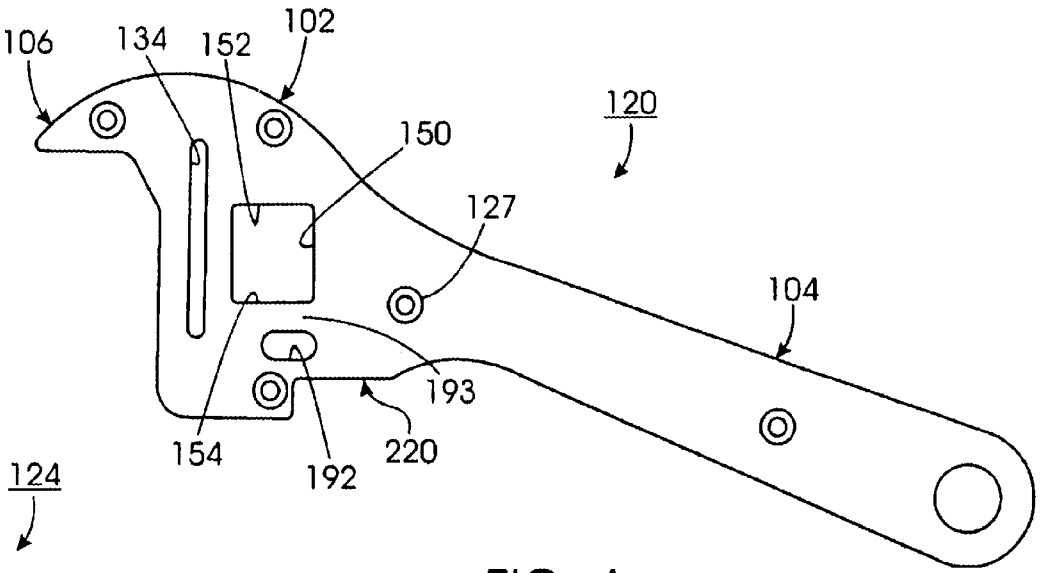
FIG. 4 illustrates an exemplary embodiment of a side lamination according to the present invention.

FIGS. 3A–B provide additional details of the present invention and further illustrate the modes of operation for wrench 100. Turning to FIG. 3A, a cross-sectional side view of wrench 100 is illustrated. The side laminations 120*a* form a side of wrench head 102, handle 104 and fixed jaw 106. (FIG. 4 depicts an isolated view of an exemplary side lamination 120.) The side laminations forming the other side of wrench 100 are not shown in order to reveal further details of wrench 100.

Figure 5:
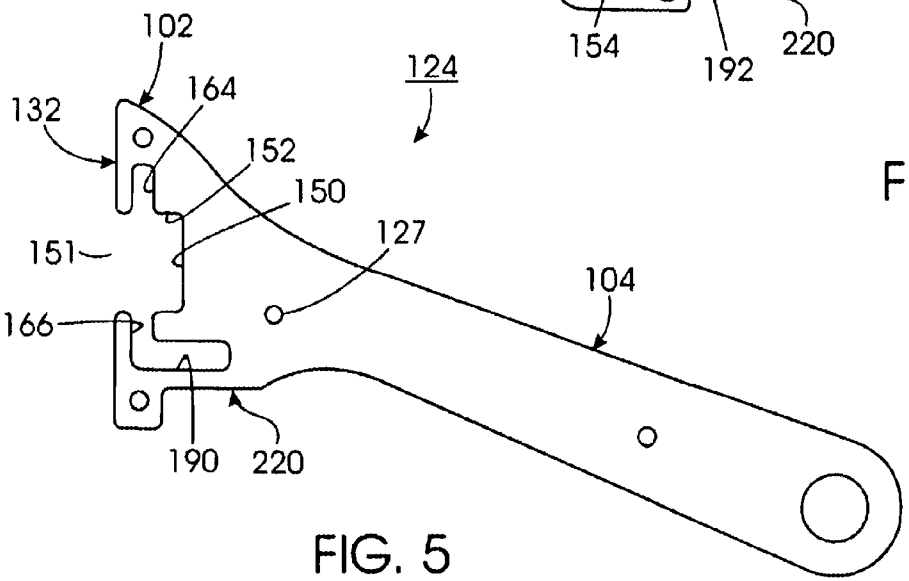
FIG. 5 illustrates an exemplary embodiment of an intermediate lamination according to the present invention.

The intermediate laminations 124 attach to the side lamination 120*a* to form wrench head 102. (FIG. 5 depicts an isolated view of an exemplary intermediate lamination 124.) Fixed jaw 106 also includes an intermediate lamination 122 attached thereto that reinforces its structure, and handle 104 preferably includes reinforcement as well. A plurality of rivets 126 hold all of the laminations 120, 122, 124 together.

Figure 6:
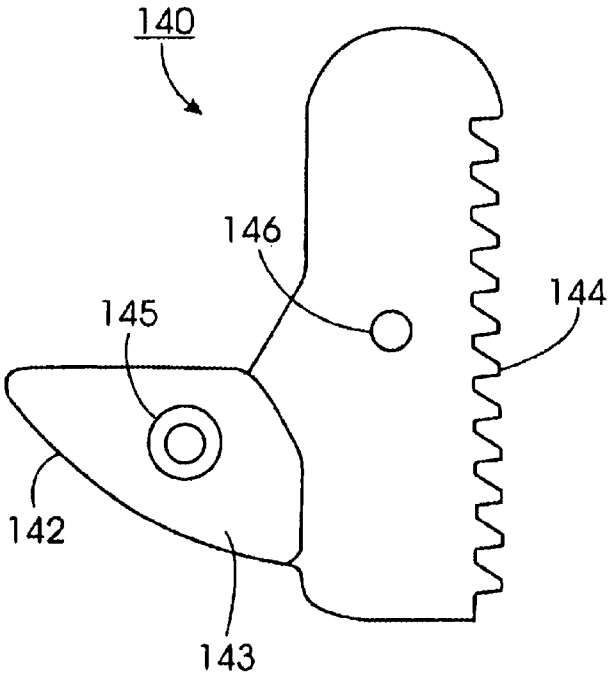
FIG. 6 illustrates an exemplary embodiment of a movable jaw according to the present invention.

A truncated edge 132 on the intermediate laminations 124 forms an inside edge of guideway 130 in wrench head 102. The side laminations 120*a* and the other side laminations (not shown) create the sidewalls for guideway 130. Adjustable jaw unit 140 is positioned within guideway 130, and rack 144 of adjustable jaw unit 140 partially extends into aperture 150. (FIG. 6 depicts an isolated view of an exemplary adjustable jaw unit 140.)

A slot/pin arrangement guides and stabilizes adjustable jaw unit 140 within guideway 130. The slot/pin arrangement includes a slot 134 adjacent to guideway 130 in the side laminations 120*a*. The other side laminations (not shown) include an identical slot (not shown) adjacent to guideway 130. A guide pin 146 projects from both sides of adjustable jaw unit 140 and fits into guide slot 134 in the side laminations 120*a*. Guide slot 134 and the other guide slot (not shown) lie parallel to each other in wrench head 102 to guide adjustable jaw unit 140 within guideway 130. In addition, the parallel slot/pin arrangement may prevent rotation of adjustable jaw unit 140 within guideway 130.

Each of the laminations 120, 124 that form wrench head 102 contains an aperture 150 therein. Stamped cutaways formed within the intermediate laminations 124 create first and second opposing spindleways 164, 166 that communicate with aperture 150. The side laminations 120*a* lack these cutaways and thereby create the sidewalls for spindleways 164, 166. Spindleways 164, 166 are aligned parallel to the axial movement of adjustable jaw unit 140 within guideway 130.

Figure 7B:
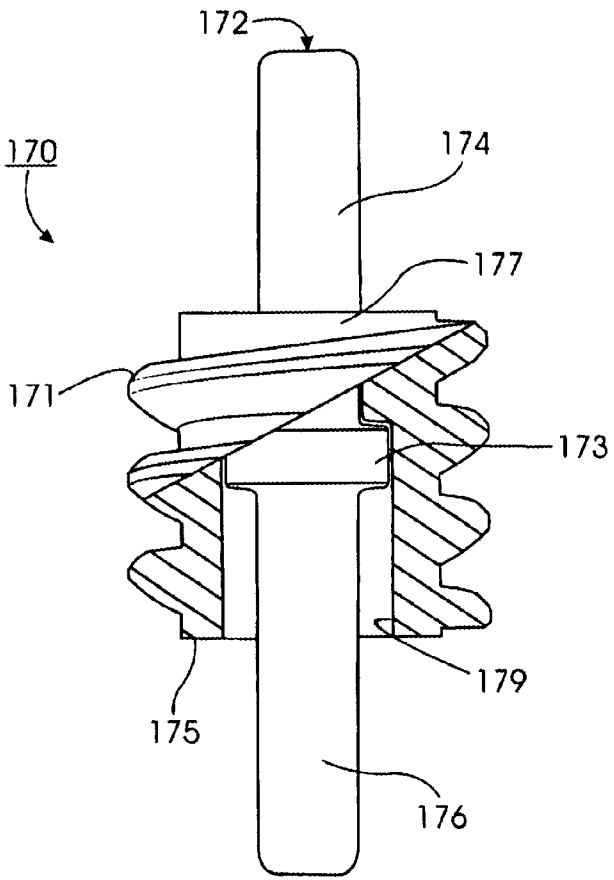
FIGS. 7A–B illustrate exemplary embodiments of a worm gear according to the present invention.
Figure 7A:
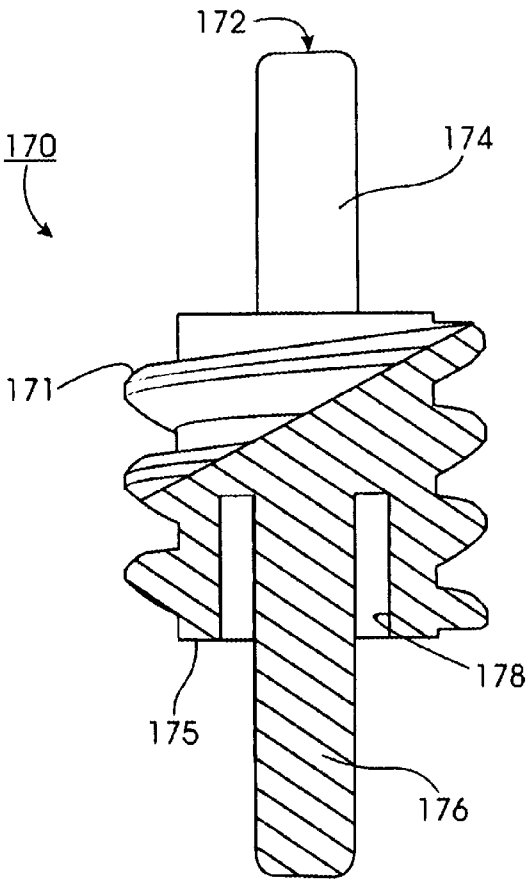

Aperture 150 accommodates a worm gear 170, which has a smaller axial dimension than aperture 150. (FIGS. 7A–B depict isolated views of exemplary embodiments of a worm gear 170.) Worm gear 170 includes rotatable portion 171 and axial member 172. Rotatable portion 171 has a winding tooth. The teeth of rack 144 project slightly into aperture 150 and engage with the winding tooth of rotatable portion 171. Rotation of rotatable portion 171 moves adjustable jaw unit 140 within guideway 130, thereby adjusting the separation between movable jaw 142 and fixed jaw 106 and allowing wrench 100 to accommodate fasteners of various sizes.

Axial member 172 is axially disposed in relation to rotatable portion 171 so that the ends of axial member 172 extend from rotatable portion 171. The ends of axial member 172 define first and second spindles 174, 176. Spindles 174, 176 of worm gear 170 slideably fit into the opposing first and second spindleways 164, 166 formed in the intermediate laminations 124. Axial member 172 with its spindles 174, 176 is mutually movable with rotatable portion 171, meaning that axial movement of rotatable portion 171 also moves axial member 172. In one embodiment as depicted in FIG. 7A, axial member 172 is integrally formed with rotatable portion 171. In another embodiment as depicted in FIG. 7B, axial member 172 is disposed within an axial bore through rotatable portion 171.

Worm gear 170 may slide axially between first and second positions within aperture 150. In the first position, spindle 174 is substantially enclosed within spindleway 164, and worm gear 170 fits adjacent to sidewall 152. In the second position, spindle 176 is substantially enclosed within spindleway 166, and worm gear 170 fits adjacent to opposing sidewall 154. A first biasing member or spring 180 is mounted on spindle 176 between worm gear 170 and sidewall 154. In the absence of other forces, spring 180 biases worm gear 170 towards the first position adjacent to sidewall 152.

Intermediate laminations 124 have an opening 190 formed therein, while the side laminations 120*a* and other side laminations (not shown) define a locking aperture 192 therein. Locking aperture 192 is adjacent to but shorter than opening 190. Opening 190 thus forms a pocket in the intermediate laminations 124 that connects with spindleway 166 in the intermediate laminations 124.

Figure 9:
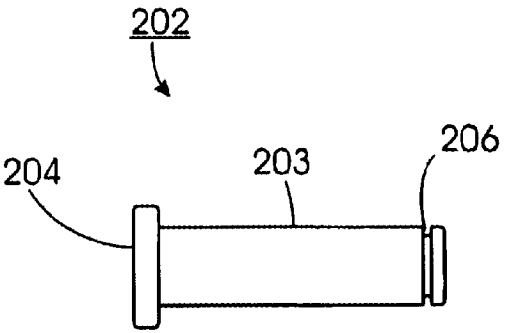
FIG. 9 illustrates an exemplary embodiment of a cross member according to the present invention.

A second biasing member or spring 194 is disposed in pocket 190. Spring 194 biases a cross member 202 towards one end of pocket 190. Cross member 202 may be a cylindrical pin, a wedge, a bar or the like that is disposed perpendicular to the laminations 120, 124. Cross member 202 moves laterally within pocket 190 such that the lateral movement of cross member 202 in pocket 190 is limited by the boundaries of locking aperture 192. (FIG. 9 depicts an isolated view of an exemplary cross member 202.)

Figure 8B:
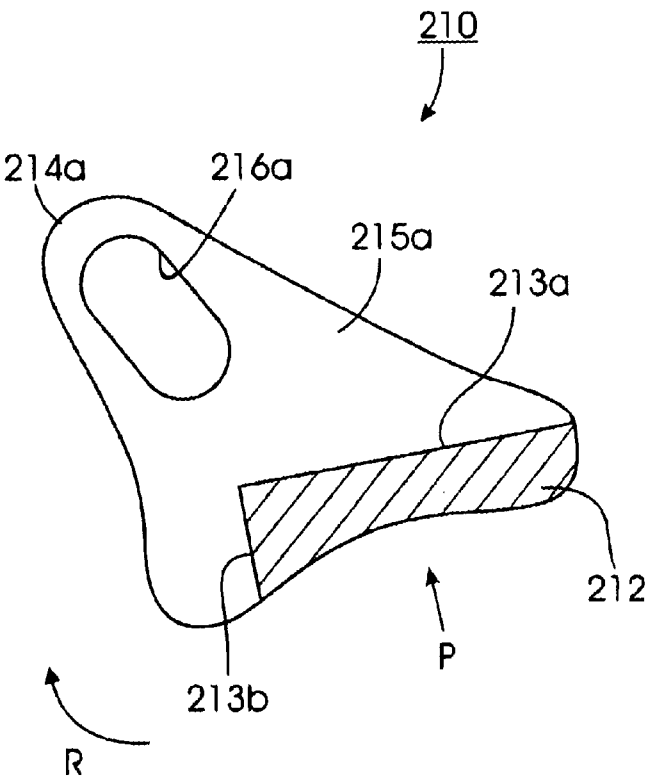
FIGS. 8A–B illustrates an exemplary embodiment of a trigger according to the present invention.
Figure 8A:
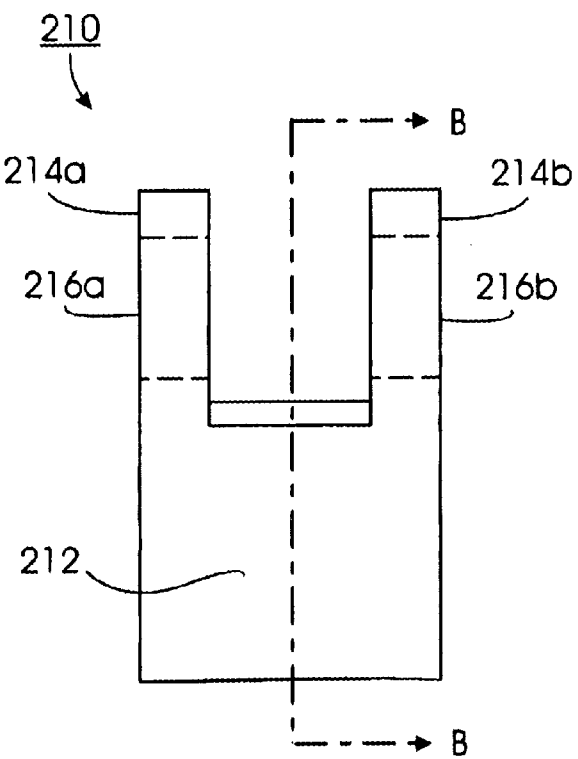

In FIG. 3A, wrench 100 is illustrated in the standard mode of operation in relation to a fastener F. Spring 180 biases worm gear 170 towards the first position adjacent to sidewall 152, and spring 194 in pocket 190 holds cross member 202 in the path of spindle 176. Cross member 202, urged by spring 194, is disposed between the end of spindle 176 and the sidewall of pocket 190, thereby preventing spindle 176 from moving further into spindleway 166. This maintains worm gear 170 in the first position in aperture 150. Trigger 210 is connected to cross member 202 and is positioned adjacent to a channel surface 220 formed on the edge of wrench head 102. (FIGS. 8A–B depict an isolated view of an exemplary trigger 210.)

The position described above represents a locked position in which wrench 100 may be used in the standard mode of operation. To rotate the fastener F, the user adjusts worm gear 170 until movable jaw 142 contacts the fastener F and clenches the sides of the fastener F between itself and fixed jaw 106. The fastener F has a first width $W_1$ between any two opposing sides, and jaws 106 and 142 are separated by that width $W_1$.

With cross member 202 in the locked position as shown in FIG. 3A, adjustable jaw unit 140 may be moved only by rotating worm gear 170 and otherwise cannot move within guideway 130. Consequently, movable jaw 142 is prevented from releasing the side of the fastener F. The locked position allows wrench 100 to operate as a standard adjustable jaw wrench to tighten or loosen the fastener F by either clockwise or counterclockwise rotation. The open-ended jaws 106, 142 also allow wrench 100 to be removed from the side of the fastener F like other conventional open-ended wrenches.

To create a ratcheting effect, the user of wrench 100 presses trigger surface 212 against channel surface 220 with a motion P. Trigger 210 pivots in a motion R on a pivot surface 213*b*, which contacts a portion of channel surface 220. Cross member 202 is leveraged by the pivoting of trigger 210 and slides laterally in pocket 190. Turning to FIG. 3B, ratcheting adjustable wrench 100 is shown unlocked in relation to the fastener F to provide the ratcheting effect. Trigger surface 212 is held against channel surface 220 by the user pressing in motion P. Cross member 202 has moved within pocket 190 and has overcome the biasing of spring 194. The movement of cross member 202 frees the path of axial movement for spindle 176 by unblocking the distal end of spindle 176, which allows spindle 176 to slide further through spindleway 166 and into pocket 190. Consequently, worm gear 170 is free to move to the second position adjacent to sidewall 154. In the absence of other forces, however, spring 180 on spindle 176 holds worm gear 170 and adjustable jaw unit 140 in the first position.

When trigger surface 212 is held against channel surface 220 to keep cross member 202 disengaged, the user may rotate wrench 100 either clockwise or counterclockwise. The corners of the fastener F bear against movable jaw 142, which separates from fixed jaw 106 to accommodate the increasing width of the fastener F. With the force on movable jaw 142, adjustable jaw unit 140 bears on worm gear 170. Worm gear 170 overcomes the force of spring 180 and slides towards the second position adjacent to sidewall 154. Because cross member 202 is removed from its path, the distal end of spindle 176 extends into the opening of pocket 190, and movable jaw 142 separates further from fixed jaw 106.

As wrench 100 is further rotated, the separation between fixed jaw 106 and adjustable jaw 142 expands to accommodate the corner-to-corner width $W_2$ of the fastener F. Worm gear 170 and adjustable jaw unit 140 are free to move until worm gear 170 meets sidewall 154 of aperture 150 as shown in FIG. 3B. Ideally, the distance that worm gear 170 can move within aperture 150 is at least the same as the difference between the second width $W_2$ and the first width $W_1$ for the largest fastener for which wrench 100 is to be used.

As the jaws 106, 142 continue to rotate relative to the fastener F past the position shown in FIG. 3B, the corners of the fastener F no longer bear directly on fixed jaw 106. Spring 180 biases worm gear 170 towards the first position adjacent to sidewall 152. Movable jaw unit 140 slides back towards jaw 106 within guideway 130 until movable jaw 142 again contacts the side of the fastener F.

At this point, the user may allow trigger 210 to move back to the locked position to return cross member 202 between the distal end of spindle 176 and the side of pocket 190. Worm gear 170 is thereby locked in place, and the jaws 106, 142 are again clenched on the sides of fastener F, as shown in FIG. 3A. Alternatively, the user may maintain the ratcheting mode of operation by holding trigger 210 in the unlocked position, as shown in FIG. 3B. Continuing to turn wrench 100 with respect to the fastener F would again result in the corners of the fastener F bearing against movable jaw 142. Spindle 176 would then be free to move into pocket 190, allowing for the ratcheting mode of operation.

As described above with reference to FIGS. 3A and 3B, adjustable jaw wrench 100 of the present invention offers both a standard and a ratcheting mode of operation. Referring again to FIG. 3A, the present invention provides wrench 100 with inherent strength when operating in the standard mode of operation. As noted above, weaknesses in a locking mechanism and other components may result in the failure of a wrench when torquing a fastener.

The present invention has the particular advantage of engaging cross member 202 on an axis 178 of the potential axial movement of worm gear 170. In other words, cross member 202 in the locked position is interposed directly between the distal end of spindle 176 and the sidewall of pocket 190 and is closely aligned with axis 178 of worm gear 170. As the fastener F is torqued with cross member 202 in the locked position, the corners of the fastener F bear on movable jaw 142. Consequently, worm gear 170 is forced against cross member 202, and the engagement of worm gear 170 with cross member 202 is axially aligned with the force applied. This alignment of cross member 202 with axis 178 of the axial movement of worm gear 170 avoids creating undesirable moment forces that might cause failure or wear of wrench 100. Additionally, the inherent strength provided by the aligned engagement of worm gear 170 and cross member 202 does not require that the components have an unduly increased robustness to enable them to withstand the forces applied.

Figure 3C:
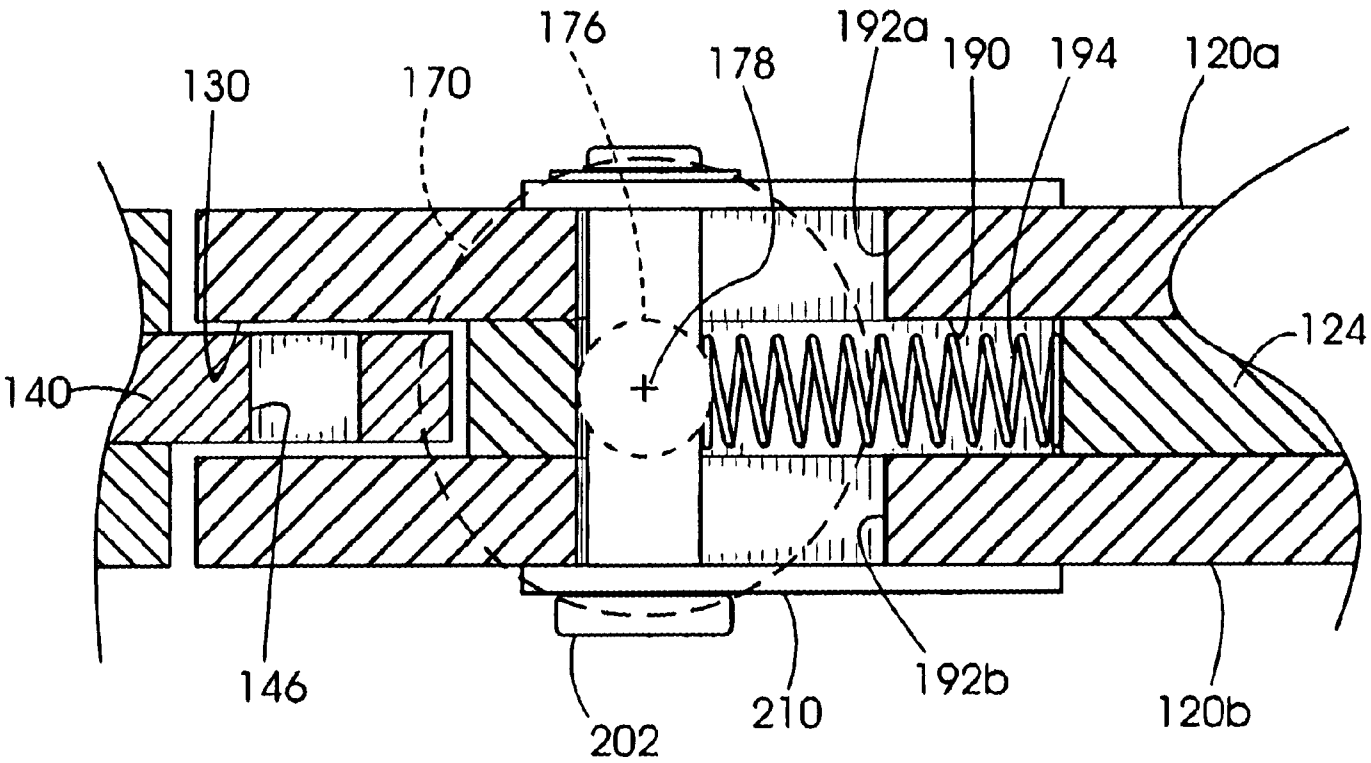
FIG. 3C illustrates a cross-sectional top view of a portion of the wrench head in FIG. 3A.

FIG. 3C is a cross-sectional top view of a portion of wrench head 102 and further illustrates the aligned engagement of the present invention. The side laminations 120*a*, 120*b* form the sides of wrench head 102 and sandwich the intermediate laminations 124. Pocket 190 is formed in the intermediate laminations 124. The side laminations 120*a* have a locking aperture 192*a* defined therein, and the side laminations 120*b* have a complementary locking aperture 192*b* defined therein. The locking apertures 192*a*, 192*b* are parallel to one another and are shorter than pocket 190 in the intermediate laminations 124 so that spring 194 fits within pocket 190.

As shown more clearly in FIG. 3A, the intermediate laminations 124 terminate as part of wrench head 102 at edge 132, while the side laminations 120*a*, 120*b* extend beyond the intermediate laminations 124 to form guideway 130 between them. Also, as shown in FIG. 3C, cross member 202 passes through the locking apertures 192*a*, 192*b* and lies perpendicular to the laminations 120*a*, 120*b* and 124. Trigger 210 connects to both ends of cross member 202 and may partially cover the locking apertures 192*a*, 192*b* on each side of wrench head 102.

Most notably in FIG. 3C, the end of spindle 176 rests on cross member 202, representing the locked position. Cross member 202 closely aligns with the axis 178 of the axial movement for worm gear 170, and the end of spindle 176 fits substantially on cross member 202. The alignment of cross member 202, spindle 176 and worm gear 170 offers an inherently strong point of engagement that can sufficiently support forces created when wrench 100 is used to torque a fastener.

Besides having inherent strength, the present invention offers a number of other advantages. For example, the present invention reduces potential for locking mechanism 200 to dislodge. The sidewalls of pocket 190 and the locking apertures 192*a,b* guide and support cross member 202 when moved between the locked and unlocked positions illustrated in FIGS. 3A and 3B. Furthermore, trigger 210 connects to both ends of cross member 202 and further holds and guides cross member 202 within pocket 190 and the locking apertures 192*a,b*. Because the movement of cross member 202 is guided, it may consistently move towards the locked position with little potential of dislodging. This advantage stands in contrast to the prior art wrench described hereinabove.

The present invention also has little potential for locking mechanism 200 to jam. For example, spindle 176 preferably forms a smooth, uniform cylinder lacking any protrusions or teeth on which cross member 202 may catch. If cross member 202 is released from the unlocked position in FIG. 3B before the jaws 106, 142 fully ratchet past the corners of the fastener F and spindle 176 leaves pocket 190, cross member 202 will not jam on the smooth end of spindle 176. In fact, the user of wrench 100 may even choose to release trigger 210 while the jaws 106, 142 are still ratcheting about the corners of the fastener F. Releasing trigger 210 before ratcheting is complete would cause biasing spring 194 to slide cross member 202 within pocket 190 and the locking apertures 192*a,b*. Cross member 202 would then contact the side of spindle 176 still extending within pocket 190. Because cross member 202 and spindle 176 do not have any protrusions, teeth or other irregularities, spindle 176 may still slide against cross member 202 until spring 180 is able to force worm gear 170 to the first position in aperture 150. Cross member 202 could then return to the locked position between the distal end of spindle 176 and the sidewall of pocket 190.

The use of a plurality of laminations to form wrench 100 provides additional advantages. For example, spindleways 164, 166 need not be intricately machined or detailed within a cast piece of metal. Creating the cutaways in the intermediate laminations 124 to form spindleways 164, 166 is far easier than boring through a cast piece of material. Similarly, guideway 130 and pocket 190 do not require intricate machining to produce.

The present invention also has the advantage of easy assembly. Briefly describing the assembly of wrench 100, the side laminations 120, as exemplified in FIG. 4, may be independently formed to complete one side of the wrench body. The side laminations 120, having aperture 150 and locking aperture 192 defined therein, form one side of wrench head 102, handle 104 and fixed jaw 106. The intermediate laminations 124, as exemplified in FIG. 5, may also be formed separately defining aperture 150, spindleways 164, 166 and the aperture for pocket 190. The intermediate laminations 124 are then positioned on the first side laminations 120.

Worm gear 170, as exemplified in FIG. 7, with spring 180 on spindle 176, is placed within aperture 150 so that spindles 172 and 176 lie within the spindleways 164 and 166 respectively. Spring 194 is positioned in pocket 190, and adjustable jaw 140, as exemplified in FIG. 6, is disposed in guideway 130. Once other necessary components are assembled, additional side laminations 120 forming the other side of wrench 100 attach to the intermediate laminations 124 to complete the assembly of the wrench body. Consequently, worm gear 170, the spindles 172, 176 and the springs 180, 194 are held within wrench 100.

Trigger 210, as exemplified in FIGS. 8A–B, is placed adjacent to channel surface 220 so that the apertures 216*a*, 216*b* align with the locking apertures 192*a,b* on both sides of wrench head 102. The distal end of cross member 202, as exemplified in FIG. 9, passes into aperture 216*a* of trigger 210 and through the aperture 192*a,b* and pocket 190 in the laminations 120, 124. The distal end of cross member 202 then passes into aperture 216*b* on the other side of trigger 210. A flat head 204 places adjacent to aperture 216*a*, and a retaining ring, such as an E-clip, then fits into groove 206 to hold cross member 202 to trigger 210.

It is understood, however, that manufacturing and machining techniques exist in the art to form wrench 100 of the present invention without the specific use of laminations. For example, two cast and machined halves forming axially symmetric sides of the wrench body could be separately formed. The sides may contain all of the necessary apertures formed or machined therein. All of the additional components could then be assembled and the two halves attached to one another using conventional fastening means or bonded together using an amorphous bonding technique. The use of laminations described herein represents a preferred embodiment of the present invention and in no way is to be construed as limiting the present invention to their exclusive use.

Besides the advantage of easy assembly, the present invention requires only simple machining to complete the components. For example, locking mechanism 200 with cross member 202 and trigger 210 does not require machining a difficult shape to fit them into the assembly of wrench 100. Because wrench 100 contains relatively few components of simple structure, meeting any tolerance requirements for manufacturing, assembling or operating the present invention poses little difficulty. Furthermore, the present invention has the advantage of requiring few components with little intricacy in order to achieve the ratcheting mode of operation. For example, the spindles 172, 176 may be integrally formed with worm gear 170, which eliminates the need to create a floating worm gear on a separate shaft. As a result of these and other advantages, the present invention offers a simple and inherently strong construction in order to achieve both the standard and ratcheting modes of operation for an adjustable jaw wrench.

Exemplary embodiments of a side lamination 120, an intermediate lamination 124, an adjustable jaw unit 140, a worm gear 170, a trigger 210 and a cross member 202 are presented in FIGS. 4–9 below. Due to the number of interrelating components, FIGS. 4–9 are presented with concurrent reference to FIGS. 2 and 3A–3C above.

FIG. 4 illustrates an exemplary embodiment of a side lamination 120 according to the present invention. A sheet of thin metal, having an exemplary thickness of approximately 0.06 inches, forms side lamination 120. Side lamination 120 represents a side of the main body of ratcheting adjustable wrench 100. Side lamination 120 has the contour of wrench head 102, handle 104 and fixed jaw 106 and includes a plurality of holes 127 for the insertion of rivets when wrench 100 is assembled.

Guide slot 134 is formed in wrench head 102 adjacent to aperture 150. Locking aperture 192 does not connect with aperture 150, but is adjacent to side 154 of aperture 150 and is separated by material 193 of lamination 120. Additionally, side lamination 120 contains channel surface 220 formed in the contour of wrench head 102.

FIG. 5 illustrates an exemplary embodiment of an intermediate lamination 124 according to the present invention. A sheet of thin metal, having an exemplary thickness of approximately 0.08 inches, forms intermediate lamination 124. Intermediate lamination 124 represents an inside section of the head and handle of wrench 100. Intermediate lamination 124 has the contour of handle 104 and forms a partial contour of wrench head 102. A plurality of holes 127 in the lamination allow for the insertion of rivets when wrench 100 is assembled. Intermediate lamination 124 also contains channel surface 220 formed in the contour of wrench head 102.

Notably, intermediate lamination 124 terminates with an truncated edge 132 to form a partial contour of wrench head 102. Truncated edge 132 forms part of guideway 130 as discussed above. Aperture 150 extends inward from edge 132 in wrench head 102. An absent side 151 of aperture 150 communicates with edge 132 so that aperture 150 may communicate with guideway 130. Also of particular note in the isolated view of FIG. 5, cutaways in the sides 152 and 154 of aperture 150 form the spindleways 164 and 166 respectively. The aperture or pocket 190 directly connects with spindleway 166.

FIG. 6 illustrates an exemplary embodiment of an adjustable jaw unit 140 according to the present invention. Adjustable jaw unit 140 has a jaw 142 mounted thereon. A lamination 143 reinforces jaw 142 and attaches to jaw 142 by a rivet 145. Adjustable jaw unit 140 includes rack gear 144 along one edge. A guide pin 146 projects from the surface of adjustable jaw unit 140 for insertion into guide slot 132 in a side lamination as discussed above. Guide pin 146 also projects from the other side of adjustable jaw unit 140. Adjustable jaw unit 140 relies on pin 146 and slots 132 in the side laminations 120*a*, 120*b* for guidance in guideway 130.

FIG. 7A illustrates a preferred embodiment of a worm gear 170 according to the present invention. Worm gear 170 includes a rotatable portion 171 and an axial member 172. Rotatable portion 171 has a winding tooth. Axial member 172 includes a first spindle 176 and a second spindle 178. The first and second spindles 176, 178 extend axially from rotatable portion 171. Axial member 172 is integrally formed with rotatable portion 171. Thus, axial member 172 is mutually movable with rotatable portion 171 and rotates with rotatable portion 171.

Rotatable portion 171 further includes an annular bore 178 therein that surrounds second spindle 178. Annular bore 178 accommodates an end of a biasing member 180 that is disposed between worm gear 170 and sidewall 154 of aperture 150 as described above. Annular bore 178 is sized to receive the coils of spring 180 as it is compressed by worm gear 170. This allows end 175 to abut sidewall 154 when spring 180 is compressed.

FIG. 7B illustrates another embodiment of a worm gear 170 according to the present invention. Worm gear 170 includes a rotatable portion 171 and an axial member 172. Rotatable portion 171 has a winding tooth and includes an axial bore 177 with a widened section 179. Axial member 172 in the embodiment of FIG. 7B is formed separately from rotatable portion 171. Axial member 172 includes an annular ledge 173, a first spindle 176 and a second spindle 178. Axial member 172 is disposed within bore 177, and first and second spindles 176 and 178 extend axially from rotatable portion 171. Widened section 179 accommodates annular ledge 173 of axial member 172.

Widened section 179 accommodates an end of biasing member 180 that is disposed between worm gear 170 and sidewall 154 of aperture 150 as described above. The end of spring 180 is disposed against annular ledge 173 of axial member 172. In this way, when rotatable portion 171 is urged to the second position in aperture 150 by adjustable jaw unit 140, axial member 172 moves mutually with rotatable portion 171 through the interference of annular ledge 173 with bore 177. Likewise, biasing spring 180 urges annular ledge 173 of axial member 172 to interfere with bore 177 of rotatable portion 171 so that rotatable portion 171 moves with the biasing of spring 180. The present embodiment may overcome certain manufacturing difficulties or associated costs in comparison to the integral axial member and rotatable portion depicted in FIG. 7A.

FIGS. 8A–B illustrate a preferred embodiment of a trigger 210 according to the present invention. Trigger 210 includes a trigger surface 212 for the placement of a finger. First and second bifurcations 214*a*, 214*b* extend therefrom. Each of the bifurcations 214*a*, 214*b* defines an aperture 216*a*, 216*b* therein to accommodate cross member 202 as described herein.

Trigger surface 212, shown in cross-section in FIG. 8B, forms a body of material. Trigger surface 212 has an inner surface 213*a*. A portion of inner surface 213*a* acts as a pivot surface 213*b* when trigger 210 is disposed against channel surface 220 on the outside edge of wrench head 102. The bifurcations 214*a*, 214*b* extend from trigger surface 212 and include apertures 216*a*, 216*b*. The apertures 216*a*, 216*b* define an elongated shape. As seen in FIG. 8B, a connecting surface 215*a* fully connects bifurcation 214*a* with trigger surface 212. Connecting surface 215*a* abuts the outside of wrench head 102 and helps guide and support trigger 210 against the sides of wrench head 102 when moved. Connecting surface 215*a* may also cover aperture 192 and spring 194. When trigger surface 212 is pressed in motion P, trigger 210 pivots in motion R on pivot surface 213*b*. Cross member 202 is leveraged by the bifurcations 214*a*, 214*b*. Cross member 202 may then move within the elongated apertures 216*a*, 216*b* as it also slides laterally in pocket 190 and locking apertures 192*a,b* as discussed above.

FIG. 9 illustrates an exemplary embodiment of a cross member 202 according to the present invention. Cross member 202 forms a cylindrical body 203 made of steel, such as 1045 steel, that is hardened and drawn to a Rockwell hardness of approximately 60. Cross member 202 has a flat head 204 at one end of cylindrical body 203. At the other end of the cylindrical body 203, a groove 206 circumscribes the outer surface to accommodate a retaining ring (not shown).

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A wrench, comprising:

a wrench head having a fixed jaw thereon, the wrench head defining a first aperture, a spindleway communicating with the first aperture, and a second aperture communicating with the spindleway;

a movable unit disposed in the wrench head, comprising a rack partially extending into the first aperture and a jaw opposing the fixed jaw;

a worm gear positioned within the first aperture and defining a central axis, comprising a rotatable portion engaging the rack and axially movable within the first aperture between a first position and a second position, and a spindle extending axially from the rotatable portion along the central axis and axially movable with the rotatable portion, the spindle having a distal end slideably disposed within the spindleway; and a locking mechanism disposed in the second aperture, the locking mechanism being movable between a locked position and an unlocked position, wherein in the locked position a portion of the locking mechanism is disposed at a first point between the distal end of the spindle and a second point on the wrench head on a side of the second aperture, said first and second points being substantially aligned with the distal end along said central axis to maintain the rotatable portion of the worm gear in the first position.

2. The wrench of claim 1, wherein the spindle is integrally formed with the rotatable portion of the worm gear and rotates with the rotatable portion.

3. The wrench of claim 1, wherein the spindle is disposed in an axial bore in the rotatable portion.

4. The wrench of claim 1, further comprising a first biasing member on the spindle biasing the worm gear towards the first position.

5. The wrench of claim 1, further comprising a second biasing member disposed in the second aperture biasing the locking mechanism towards the locked position.

6. The wrench of claim 1, wherein the locking mechanism comprises a cross member.

7. The wrench of claim 6, wherein the cross member comprises a cylindrical pin.

8. The wrench of claim 6, further comprising a trigger connected to the cross member to move the cross member between the locked and the unlocked positions.

9. The wrench of claim 8, wherein the trigger is pivotable in relation to the wrench head and leverages the cross member to move within the second aperture.

10. The wrench of claim 9, wherein the trigger comprises first and second bifurcations, each of the bifurcations defining an elongated aperture therein to receive the cross member.

11. The wrench of claim 1, wherein a plurality of laminations form the wrench head.

12. The wrench of claim 11, wherein the plurality of laminations comprise:

at least one side lamination forming a first side of the wrench head;

at least one side lamination forming a second side of the wrench head; and at least one intermediate lamination disposed between the side laminations.

13. A wrench, comprising:

a wrench head having a fixed jaw, the wrench head comprising a first lamination defining one side of the wrench head, a second lamination defining another side of the wrench head, and an intermediate lamination defining at least a portion of the wrench head and situated between the first and second laminations, each of the first, second and intermediate laminations defining a first aperture therein, the intermediate lamination defining therein a first cutaway communicating with the first aperture and defining therein a second cutaway communicating with the first cutaway;

a movable jaw unit disposed in the wrench head, the jaw unit comprising a jaw opposing the fixed jaw and a rack gear partially extending into the first aperture;

a worm gear having a rotatable portion and a spindle extending axially from the rotatable portion along a central axis of the worm gear, the spindle having a distal end that is slideably disposed within the first cutaway, the worm gear engaging the rack gear and movable within the first aperture between a first position and a second position; and a locking mechanism disposed in the second cutaway, the locking mechanism movable between a locked position and an unlocked position.

wherein in the locked position a portion of the locking mechanism is disposed along the central axis at a point between the distal end of the spindle and a side of the second cutaway to hold the worm gear in the first position.

14. The wrench of claim 13, wherein the spindle is integrally formed with the rotatable portion of the worm gear and rotates with the rotatable portion.

15. The wrench of claim 13, wherein the spindle is disposed in an axial bore in the rotatable portion.

16. The wrench of claim 13, further comprising a first biasing member disposed on the spindle and biasing the worm gear towards the first position.

17. The wrench of claim 13, further comprising a second biasing member disposed in the second cutaway and biasing the locking mechanism towards the locked position.

18. The wrench of claim 13, wherein the locking mechanism comprises a cross member extending perpendicularly into the second cutaway.

19. The wrench of claim 18, further comprising a trigger connected to the cross member to move the cross member between the locked and the unlocked positions.

20. An adjustable jaw wrench, comprising:

a wrench head having a fixed jaw thereon;

a movable unit disposed in the wrench head and having a jaw opposing the fixed jaw;

a worm gear positioned in the wrench head and engaged with the movable unit, the worm gear defining a central axis;

means for moving the worm gear along the central axis between a first and a second position;

means for retaining the worm gear in the first position by selectively moving a portion of the retaining means to a point, the point being on the central axis and between the worm gear and a portion of the wrench head to block movement of the worm gear out of the first position, the central axis extending through the portion of the wrench head; and means for freeing the worm gear to move towards the second position.

21. The adjustable jaw wrench of claim 20, further comprising means for biasing the worm gear towards the first position.

22. The adjustable jaw wrench of claim 20, further comprising means for biasing the portion of the retaining means towards the point on the central axis.

23. An apparatus for gripping a workpiece, comprising:

a first body element having a fixed jaw thereon;

a second body element slideably disposed in the first body element, the second body element having a rack thereon and a jaw opposing the fixed jaw;

a rotatable element positioned in the first element to engage the rack and defining a central axis, the rotatable element movable on the central axis between a first position and a second position and having an axial element extending therefrom on the central axis; and a blocking element positioned in the first body element, the blocking element movable between engaged and disengaged positions with respect to a distal end of the axial element, wherein in the engaged position the blocking element is disposed at a point, the point being on the central axis and between the distal end of the axial element and a portion of the first body element to maintain the rotatable element in the first position, the central axis extending through the portion of the first body element; and wherein moving the blocking element to the disengaged position frees the distal end of the axial element and allows the rotatable element to move to the second position.

24. The apparatus of claim 23, further comprising a first biasing element biasing the rotatable portion towards the first position.

25. The apparatus of claim 23, further comprising a second biasing element biasing the blocking element towards the engaged position.

26. The apparatus of claim 23, further comprising a trigger connected to the blocking element to move the blocking element between the engaged and the disengaged positions.

* * * * *